United States Patent [19]

Jackson et al.

[11] Patent Number: 4,923,304

[45] Date of Patent: May 8, 1990

[54] APPARATUS FOR DISPENSING A BLENDED COMPOSITION OF PARTICULATE INGREDIENTS

[75] Inventors: Miles N. Jackson; Peter J. Rogers; Brenda L. Watson, all of Cobourg, Canada

[73] Assignee: General Foods Inc., Don Mills, Canada

[21] Appl. No.: 861,478

[22] Filed: May 9, 1986

[51] Int. Cl.[5] ..... B01F 5/24; B01F 15/02

[52] U.S. Cl. ..... 366/184; 222/459; 366/336

[58] Field of Search ..... 366/184, 192, 193, 336, 366/337, 338; 222/459

[56] References Cited

U.S. PATENT DOCUMENTS

| | | | |
|---|---|---|---|
| 2,460,605 | 2/1949 | Soissa | 366/336 X |
| 3,066,920 | 12/1962 | Prosser | 366/338 |
| 3,208,737 | 9/1965 | Brown | 366/338 X |
| 4,286,883 | 9/1981 | Johanson | 366/184 X |
| 4,358,207 | 11/1982 | Roth | 366/336 |

*Primary Examiner*—Philip R. Coe
*Assistant Examiner*—Scott J. Haugland
*Attorney, Agent, or Firm*—Linn I. Grim; Daniel J. Donovan

[57] ABSTRACT

Apparatus for dispensing a blended composition of particulate ingredients, comprising a bin section, a cone section, and an outlet section. The bin section holds a supply of the composition, and the cone section includes inner and outer cones for conducting downward, respectively, first and second portions of the composition discharged from the bin section. The outlet section is located below the cone section to receive those first and second portions of composition from the cone section; and the outlet section includes a conical plug extending below the inner cone to retard the flow of the first portion of the composition through the inner cone, and to mix the first portion of the composition with the second portion thereof.

9 Claims, 1 Drawing Sheet

FIG. 1
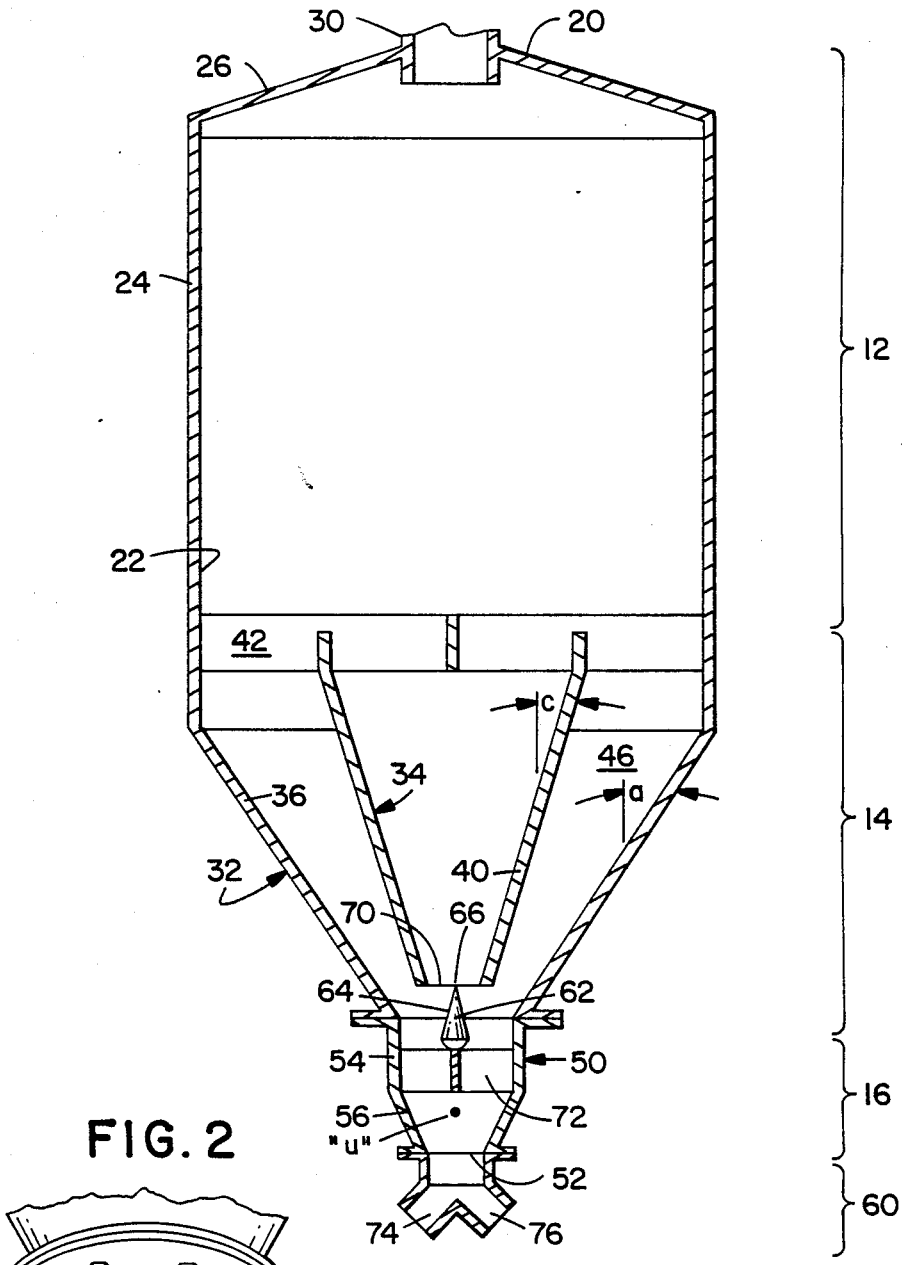
FIG. 2
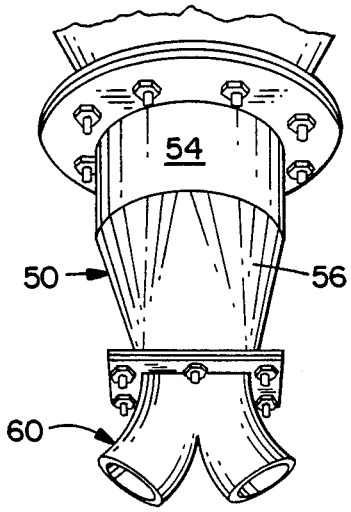
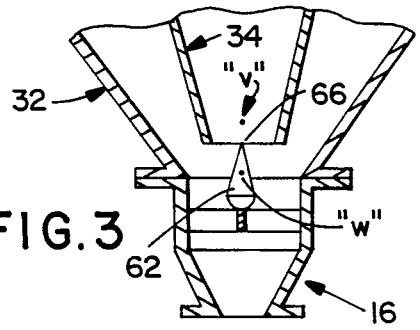
FIG. 3

APPARATUS FOR DISPENSING A BLENDED COMPOSITION OF PARTICULATE INGREDIENTS

BACKGROUND OF THE INVENTION

This invention generally relates to apparatus for dispensing particulate materials, and more specifically, to apparatus for dispensing a blended composition of particulate ingredients.

Several food products consist of a uniform blend or mixture of two, three or more different particulate ingredients and, for example, jelly powder includes sugar particles mixed in a gelatin powder. These food products are normally prepared by blending large quantities of the ingredients together to produce a uniform bulk mixture, filling a large dispensing or feeding small quantities of this large bulk mixture into small, individual packages that are then prepared for sale to the consumer.

With such a process, it is difficult to insure that the small quantities fed into the individual packages always contain the proper proportion of the different ingredients because, among other reasons, the ingredients may tend to segregate from each other as they pass through large conventional particulate dispensing devices. Several prior art particle dispensing processes and apparatus are known that generally produce excellent results; however, even with such processes and apparatus, normally, both the first and the last few pounds of product drawn from the dispensing apparatus do not contain the proper proportion of ingredients. Usually, these first and last few pounds of the product are not used to fill the small packages and, instead, are drawn from the dispensing apparatus, later remixed with fresh ingredients, and re-poured, with these fresh ingredients, back into the dispensing apparatus.

For example, apparatus similar to the one shown in U.S. Pat. No. 4,286,883 has been used to dispense a jelly powder into small packages. In particular, the apparatus utilized to dispense the mix included a cylindrical top bin section, a pair of coaxial, cones extending inwardly downwardly from the bin section, and an outlet section extending downward from those cones. The whole apparatus was filled with about 1500 pounds of the jelly powder, which had previously been mixed to obtain a uniform blend of the constituent ingredients; and a pair of delivery arms were connected to the outlet of the apparatus and used to fill small packages at about 85 grams of the jelly powder to each package.

Generally, good results were obtained with this process, and the vast majority off the filled packages contained the desired proportion of ingredients. However, contrary to expectations, the proportion of ingredients in the approximately first and last fifty pounds of product dispensed from the apparatus deviated appreciably from acceptable standards, and those first and last fifty pounds were not used to fill the small individual packages. Rather, in accordance with the previously mentioned usual procedure, those first and last fifty pounds of product were simply drawn from the dispensing apparatus, remixed with new ingredients, and then repoured, with the new ingredients, back into the dispensing apparatus.

SUMMARY OF THE INVENTION

An object of this invention is to fill small packages with product from a bulk supply of a blended composition of particulate ingredients, where the proportion of ingredients in each package is the same as in that bulk supply.

Another object of the present invention is to fill small packages with product from a bulk supply of a blended composition of particulate ingredients, and to maintain the proportion of ingredients in the first and last few pounds of product drawn from the bulk supply, the same as, or within an acceptable deviation of, the proportion of ingredients in that bulk supply.

A further object of this invention is to retard the flow of particulate material through the inner of a pair of inner and outer cones of a particle dispensing apparatus, while simultaneously remixing in that apparatus the particles discharged from those cones.

These and other objects are attained with apparatus for dispensing a blended composition of particulate ingredients, comprising a bin section, a cone section, and an outlet section. The bin section is provided for holding a supply of the blended composition, and has an inlet for receiving the composition and an outlet for discharging the composition from the bin section. The cone section is located below the bin section to conduct particulate materials downward therefrom, and the cone section includes outer and inner cones. The outer cone is connected and extends downward from the bin section, and has a first conical, annularly closed and downwardly inwardly sloping interior surface; and the inner cone is supported within the outer cone, and has a second, conical, annularly closed and downwardly inwardly sloping interior surface.

The inner and outer :ones form an outer annulus therebetween; and, in use, a first portion of the composition discharged from the bin section is conducted downward through the inner cone, and a second portion of the composition discharged from the bin section is conducted downward through the outer annulus between the inner and outer cones. The outlet section is located below and is connected to the cone section to receive those first and second portions of the composition, and to conduct those portions from the dispensing apparatus. This outlet section includes a conical plug extending below the inner cone, and having a conical, annularly closed and downwardly outwardly sloping exterior surface to retard the flow of the first of the composition through the inner cone, and to deflect outward that first portion of the composition to mix the first portion with the second portion of the composition.

Further benefits and advantages of the invention will become apparent from a consideration of the following detailed description given with reference to the accompanying drawing, which specifies and show preferred embodiments of the invention.

A BRIEF DESCRIPTION OF THE DRAWINGS

FIG. 1 is an elevation view in section showing a preferred form of the dispensing apparatus of this invention.

FIG. 2 is a perspective view of the outlet section of the apparatus shown in FIG. 1.

FIG. 3 is a side cross-sectional view of a portion of the apparatus illustrated in FIG. 1, showing three different locations for the apex of the conical plug of that apparatus.

DETAILED DESCRIPTION OF THE PREFERRED EMBODIMENTS

FIG. 1 illustrates the preferred form of the dispensing apparatus of this invention, generally designated at 10 and comprising top bin section 12, cone section 14, and outlet section 16.

Bin section 12 is provided for holding a supply of a blended composition of particulate ingredients; and the bin section has inlet 20 for receiving the blended composition, and outlet 22 for discharging the composition from the bin section. Preferably, bin section 12 has a central vertical axis which defines the axis of apparatus 10; and the bin includes a vertical cylindrical wall 24 having a substantially open bottom forming outlet 22, and closed by top cover 26 having a central opening forming bin inlet 20. Inlet line 30 is connected to opening 20 to conduct a blended composition of solid particulate ingredients into bin section and suitable control means (not shown) may be connected to the inlet line to control the quantity and rate of material conducted into the bin section.

Cone section 14 is located below bin section 12 for conducting downward particulate material discharged from the bin section, and also for holding a further supply of the blended composition, and this cone section includes outer and inner cones 32 and 34. Outer cone 32 is connected to and extends downward from bin section 12, preferably coaxially therewith; and the outer cone has a first, conical annularly closed and downwardly inwardly sloping interior surface 36 forming an angle "a" with the vertical. For example, outer cone 32 may be integrally connected to and extend downward from a bottom circumferential edge of cylindrical side wall 24, although other arrangements for connecting the outer cone to bin section 12 may be used in the present invention.

Inner cone 34 is supported within the outer cone 32, and the inner cone has a second, concial, annularly closed and downwardly inwardly sloping interior surface 40 that forms an angle "c" with the vertical. Inner cone 34 may be supported by three or four struts or plates 42 joined together along the vertical axis of apparatus 10 and extending outward to cylindrical side wall 24.

In the embodiment of the invention that was actually reduced to practice, surfaces 36 and 40 satisfy the requirements set forth in the above-mentioned U.S. Pat. No. 4,286,883. The first of these requirements is that the angle that surface 36 makes with horizontal be greater than the "surface friction angle," which is defined as the minimum angle between that surface and the horizontal at which the weight of the solids on the surface overcomes the frictional force tending to prevent the solids from sliding down that surface.

The remaining requirements met by surfaces 36 and 40 relate to a condition referred to as "mass flow," which in general is defined as a condition in which all of the solids material within a hopper is in motion whenever any of that material is being drawn out from the hopper. When a hopper of conical configuration is used to dispense or conduct a particulate material, there is a certain angle, measured betwen the interior surface of the hopper and the vertical, below which that material will exhibit mass flow but above which it will not. This angle, which is normally empirically determined, is referred to as the "mass flow angle" for that specific combination of hopper and material.

With the embodiment of the invention that was actually reduced to practice, the angle "c" and the included angle whose magnitude is the difference (a−c) are each less than the mass flow angle for the particular composition dispensed from apparatus 10. In addition, the entire surface 36 of outer cone 32 lies within an angle equal to the mass flow angle subtended between inner cone 34 and a hypothetical cone having a common apex with that inner cone.

As described above, outer and inner cones 32 and 34 define outer annulus 46 therebetween; and, in the operation of dispenser 10, discussed in greater detail below, a first portion of the blended composition discharged from bin section 12 is conducted downward through the inner cone 34, and a second portion of the composition discharged from the bin section is conducted downward through outer annulus 46. Outlet section 16 is located below and is connected to cone section 14 to receive and to remix those first and second portions of the blended composition, and to conduct those re-mixed first and second portions from dispensing apparatus 10.

More specifically, outlet section 16 includes outside shell 50 connected to and extending downward from outer cone 32, preferably coaxial therewith, to guide particulate material downward from cone section 14, and the bottom end of this outside shell forms outlet 52 for discharging material from dispensing apparatus 10. With reference to FIGS. 1 and 2, outside shell 50, in turn, includes cylindrical segment 54, which is connected to and extends vertically downward from the bottom circumferential edge of outer cone 32, and transition segment 56, which extends downward from cylindrical segment 54. The upper portion of transition segment 56 has a circular, horizontal cross-section, matching the size and shape of the horizontal cross-section of cylindrical segment 54; while the bottom portion of transition segment 56 has a square horizontal cross-section, matching the size and shape of the horizontal cross-section of delivery section 60, discussed in greater detail below. Preferably, the angles between the surfaces of segments 54 and 56 of outside shell 50 and the vertical are all less than the mass flow angle for the composition dispensed through apparatus 10 so that mass flow conditions, as described above, exist inside shell 50.

Outlet section 16 further includes conical plug 62 extending below inner cone 34, preferably coaxial with outer and inner cones 32 and 34, and the plug has an annularly closed, downwardly outwardly sloping exterior surface 64. Because of this specific position and shape, conical plug 62 both retards the flow of the portion of the blended composition that passes downward through inner cone 34 and, also, deflects outward that same portion of the composition to mix that portion with the portion of the composition conducted downward through the outer annulus 46 between outer and inner cones 32 and 34.

It is believed to be important that external surface 64 of conical plug 62 taper upwardly to a point or apex 66. It is also felt to be important that the exterior surface 64 of conical plug form an angle with the vertical that is greater than about 5° and less than about 45°, preferably that angle is between about 15° and 25°. In addition, it is felt to be advantageous to form inner cone 34 with an outlet having a horizontal bottom edge 70 for discharging the composition therefrom, and to position apex 66 of plug 62 at the same level as that bottom edge of the inner cone.

Conical plug 62 may be supported by four struts or plates 72 joined together along the vertical axis of apparatus 10 and extending outward therefrom to outside shell 50. Preferably, plug 62 is held substantially entirely within the surface defined by the downward continuation of surface 40 to the apex of inner cone 34—that is, the inner cone defines an apex, identified as point "u" in FIG. 1, and if surface 40 of the inner cone were extended to that apex, plug 62 would be located substantially entirely inside the cone defined by that surface. In this way, plug 62 is maintained substantially outside the downward continuation of outer annulus 46, and thus does not directly affect material passing downward through that annulus.

With the embodiment of apparatus 10 shown in FIG. 1, conical plug 62 is supported by means adapted to hold the plug in one, fixed position relative to outer and inner and cones 32 and 34. Alternately, for example as shown in FIG. 3, plug may be supported in apparatus 10 by means adapted to hold the plug in a plurality of different, vertically spaced positions along the axis of outer and inner cones 32 and 34, for example between positions where apex 66 of the plug is at the points "v" and "w" in FIG. 3

In the above-described embodiment of the invention, outer and inner cones 32 and 34 are both conical right circular cones. However, the present invention is not limited to right circular cones; and the word "cone" as used herein, and in the appended claims, is defined by the general definition: any surface generated by moving a straight line that passes through a fixed point, along a closed, horizontal curve spaced from that point.

Preferably, outer and inner cones 32 and 34 have a common apex "u" on the axis of dispenser 10. However, this is not believed to be necessary to the practice of this invention, and it is believed that the apex of cone 32 may be above or below the apex of cone 34. Furthermore, as shown in FIG. 1, the lowermost end of outer cone 32 is somewhat lower than the lowermost end of inner cone 34. In cases where the angle "a" exceeds the mass flow angle, outer cone 32 should not extend downwardly below an arc struck about the common apex "u" and passing through the lowermost end of inner cone 34, otherwise that inner cone may not be able to insure mass flow through annulus 46. Hence, any portion of outer cone 32 that extends below this arc should form an angle with the vertical that is less than the mass flow angle.

In the operation of apparatus 10, delivery section 60, including first and second delivery arms 74 and 76, is connected to outlet section 16, directly below and in communication with discharge outlet 52, to receive the blended composition form apparatus 10. Conventionally, flexible delivery tubes (not shown) are connected to arms 74 and 76 to conduct the blended composition therefrom into small individual packages. Further, valving means (also not shown), for instance a conventional rotary valve, is located in or connected to each delivery arm 74 and 76 to control the flow of the composition through those arms and into the individual packages.

The composition is mixed in any suitable device, such as a ribbon mixer, to achieve a uniform mixture of the ingredients of the composition prior to being poured into apparatus 10. As solids flow down apparatus 10, a velocity profile develops within cone section 14. It was found that, in the absence of conical plug 62, the average velocity of material passing downward through inner cone 34 was slightly greater than the average velocity of material passing downward through outer annulus 46, and consequently the inner cone emptied of material prior to the outer annulus. It is believed that this is one reason why, without conical plug 62, the last fifty pounds or so of material discharged from apparatus 10 did not contain the desired proportion of ingredients.

It was found that adding conical plug 62 made the average downward velocity of particles passing downward through outer annulus 46. Consequently, as material is discharged from apparatus 10, inner cone 34 and outer annulus 46 empty at about the same time, and this is felt to be one reason why, when apparatus 10 is provided with conical plug 62, even the very last few pounds of material drawn from the apparatus contain the proper proportion of ingredients.

While it is apparant that the invention disclosed herein is well calculated to fulfill the objects previously stated, it will be appreiciated that numerous modifications and embodiments may be devised by those skilled in the art, and it is intended that the apended claims cover all such modifications and embodiments as fall within the true spirit and scope of the present invention.

We claim:

1. Apparatus for dispensing a blended composition of particulate ingredients, comprising:

a bin section for holding a supply of the blended composition, and having an inlet for receiving the composition and an outlet for discharging the composition from the bin section;

a cone section located below the bin section, and including:

(i) an outer cone connected to and extending downward from the bin section, and having a first conical, annularly closed and downwardly inwardly sloping interior surface, and (ii) an inner cone supported within the outer cone, and having a second conical, annularly closed and downwardly sloping interior surface to conduct downward a first portion of the composition discharged from the bin section, the inner and outer cones forming an outer annulus therebetween to conduct downward a second portion of the composition discharged from the bin section; and an outlet section located below and connected to the cone section to receive the first and second portions of the composition therefrom, and to conduct said first and second portions from the dispensing apparatus, and including a conical plug extending below the inner cone, and having a conical, annularly closed and downwardly outwardly sloping exterior surface to retard the flow of said first portion of the composition through the inner cone, and to deflect outward said first portion of the composition to mix said first portion with said second portion of the composition.

2. Apparatus according to claim 1 wherein the exterior surface of the conical plug tapers upwardly inwardly to an apex at a top of the plug.

3. Apparatus according to claim 2 wherein the bin section has a central, vertical axis, and the inner and outer cones and the conical plug are coaxial with the bin section.

4. Apparatus according to claim 2 wherein:

the inner cone includes an outlet having a horizontal bottom edge for discharging the first portion of the composition from the inner cone; and the apex of the conical plug is level with the horizontal bottom edge of the inner cone.

5. Apparatus according to claim 2 wherein the inner cone defines an apex, and the outlet section further includes means holding the plug substantially entirely within the surface defined by the downward continuation of the second conical surface to the apex of the inner cone, to inhibit the plug from directly impeding the flow of the second portion of the composition through the outer annulus.

6. Apparatus according to claim 2 wherein the exterior surface of the plug forms an angle of about 5° to about 45° with the vertical.

7. Apparatus according to claim 2 wherein the exterior surface of the plug forms an angle of about 15° to about 25° with the vertical.

8. Apparatus according to claim 2 wherein the plug makes the average downward velocity of the first portion of the composition substantially equal to the average downward velocity of the second portion of the composition.

9. Apparatus according to claim 2 wherein the outlet section further includes means adapted to hold the plug in a plurality of different, vertically spaced positions along the axis of the inner and outer cones.

* * * * *